US005457824A

United States Patent [19]

Reed

[11] Patent Number: 5,457,824

[45] Date of Patent: Oct. 17, 1995

[54] EASILY REMOVABLE AND ATTACHABLE TOILET SEAT CONNECTOR AND METHOD

[76] Inventor: Timothy M. Reed, 97 Ludlow St., Saratoga Springs, N.Y. 12866

[21] Appl. No.: 235,092

[22] Filed: Apr. 29, 1994

[51] Int. Cl.[6] ..... A47K 13/26

[52] U.S. Cl. ..... 4/234; 4/237; 411/55; 411/60

[58] Field of Search ..... 4/234, 236, 237, 4/240; 411/55, 60, 61, 383, 395

[56] References Cited

U.S. PATENT DOCUMENTS

| | | | |
|---|---|---|---|
| 1,116,710 | 11/1914 | Keller | 411/60 |
| 3,063,063 | 11/1962 | Brooks | 4/236 |
| 3,613,130 | 10/1971 | Sansone | 4/240 |
| 4,416,048 | 11/1983 | Otte | 411/60 X |

FOREIGN PATENT DOCUMENTS

| | | | |
|---|---|---|---|
| 0480534 | 4/1992 | European Pat. Off. | 4/234 |
| 0316561 | 11/1919 | Germany | 4/234 |
| 2167096 | 5/1986 | United Kingdom | 4/237 |

*Primary Examiner*—Charles E. Phillips
*Attorney, Agent, or Firm*—Heslin & Rothenberg

[57] ABSTRACT

An easily removable and attachable toilet seat connector and method is disclosed herein. The device of the present invention comprises a threaded bolt and a nut which is threadable thereto. The threaded bolt has an axially extending aperture. A pin fits within the axially extending aperture of the threaded bolt. The radius of the pin is expandable, thereby securing the pin to a toilet seat mounting bracket, the mounting bracket having a bracket hole extending therethrough to accept the pin. The pin also has a threaded aperture axially extending therein, and a screw is threadable with the threaded aperture of the pin to provide radial expansion of the pin. The method for attaching a toilet seat to a toilet bowl basin first comprises inserting the threaded bolt into a toilet bowl basin hole and threading a nut to said threaded bolt. Thereafter, the radially expandable pin is inserted into a bracket hole of a toilet seat mounting bracket. The radius of the pin is expanded to secure the pin to the toilet seat. Finally, the pin is inserted into the aperture of the threaded bolt, thereby securing the toilet seat to the toilet bowl basin.

13 Claims, 1 Drawing Sheet

EASILY REMOVABLE AND ATTACHABLE TOILET SEAT CONNECTOR AND METHOD

BACKGROUND OF THE INVENTION

1. Technical Field

The present invention generally relates to a bolting device and method. More particularly, the present invention relates to a bolting device and method for attaching and removing a toilet seat to or from a toilet bowl basin.

2. Background Information

Once a toilet seat is fastened to a toilet bowl basin, it is difficult to clean the areas surrounding the toilet seat where the seat is connected to the toilet bowl basin. If one wishes to clean those hard to reach areas, the toilet seat must be removed by first disengaging the seat from the basin. Disengaging the seat typically involves removing two nuts which are located underneath the outer wings of the toilet bowl basin. Removing these nuts is often a difficult task. For instance, the person removing the toilet seat, in order to have sufficient access to the nuts connecting the seat to the basin, may need to lay on his or her back on the floor of the bathroom. Once the person positions his or her body to access the nut, that person must thereafter maneuver his or her hand into a comfortable position for rotation and removal of the nut. However, the nut may be fastened so tightly that a wrench is required to remove the nut. The use of a wrench makes it more difficult to remove the nut.

If the cleaning person is successful in removing the seat from the toilet bowl basin, this person must repeat his or her acrobatics to attach the seat to the toilet bowl basin after cleaning is complete. Due to the nuisance in removing and attaching toilet seats, those hard-to-reach areas of toilets are often neglected, resulting in a build up of filth. Such an unsanitary and unhygienic condition in a bathroom may lead to the spread of disease. The device of the present invention also greatly speeds up the cleaning process.

Moreover, typical toilet seats often do not feel sufficiently secured to toilet bowl basins, and therefore toilet seats often have a certain degree of "play". This is because the diameter of the toilet seat bolt which extends through the hole in the toilet bowl basin is usually much smaller than the diameter of the basin hole. The difference in diameter thus permits the toilet seat to feel loose and unsecure.

Thus, a need exists for an easily removable and attachable toilet seat connection device. Moreover, a need exists for a toilet seat connector which fastens a toilet seat tightly to a toilet bowl basin.

SUMMARY OF THE INVENTION

Briefly, the present invention satisfies the need for an easily removable and attachable toilet seat connector and method of connection.

The toilet seat connector comprises, in one embodiment, four elements. The first element is a threaded bolt having an axial aperture extending therethrough. A nut is threadable with the threaded bolt. A radially expandable pin is insertable into the aperture of the threaded bolt. When the pin radius is expanded, the pin is secured to a toilet seat mounting bracket, said mounting bracket having a hole therein to accept said pin. Finally, a means for expanding the radius of the pin permits radial expansion of the pin.

It is, therefore, a principal object of this invention to provide an easily removable toilet seat connection device.

It is a further object of this invention to provide an easily attachable toilet seat connection device.

It is an additional object of this invention to provide a method for easily removing a toilet seat from a toilet bowl basin.

It is yet another object of this invention to provide a method for easily attaching a toilet seat to a toilet bowl basin.

It is still yet another object of this invention to provide an easily removable and attachable toilet seat connection device to facilitate quick and easy cleaning of toilets.

It is another object of this invention to provide a toilet seat connector which tightly fastens a toilet seat to a toilet bowl basin.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
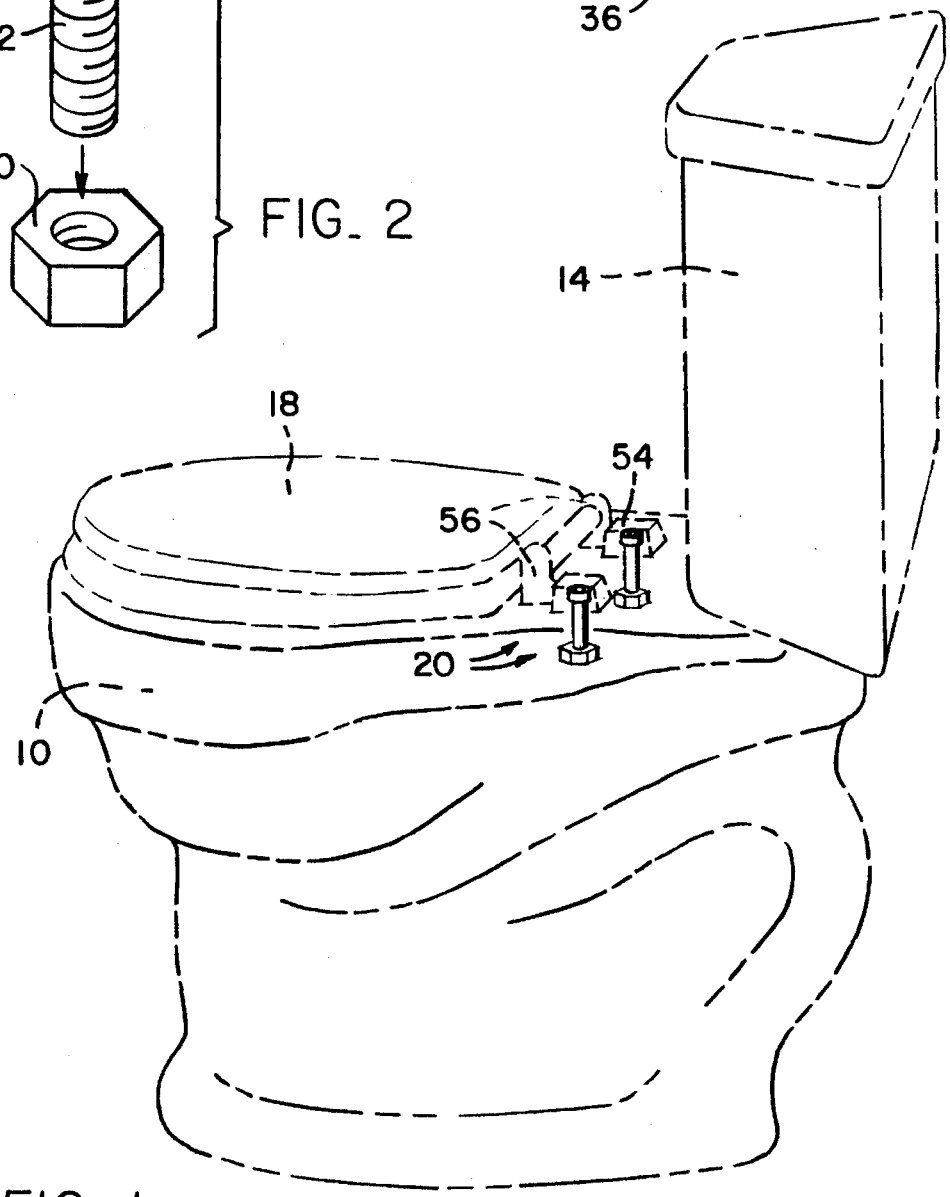
FIG. 1 depicts the present invention in conjunction with a toilet bowl basin and toilet seat.

Referring to the drawings in detail, FIG. 1 shows a toilet bowl basin 10, tank 14, and toilet seat 18, all in conjunction with the present invention 20. Toilet seat 18 is connected to the toilet bowl basin 10 with the connection device of the present invention.

Figure 2:
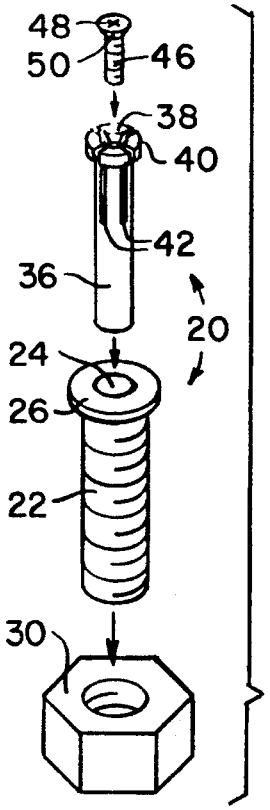
FIG. 2 is an orthographic view of the present invention showing the individual components thereof.

In one embodiment, the easily removable and attachable toilet seat connection device comprises four components, as depicted in FIG. 2. Referring to FIG. 2, a threaded bolt 22 is shown having an aperture 24 extending axially through the length of the bolt. The aperture 24 may extend fully from the top of the threaded bolt 22 through to the bottom of the bolt. Essentially, threaded bolt 22 has a bore extending axially therethrough. The internal wall of aperture 24 is preferably smooth. At the top of threaded bolt 22 there is a rim 26 having a diameter greater than the diameter of the threaded portion of bolt 22. The diameter of rim 26 is also greater than the diameter of a hole 11 of toilet bowl basin 10. A nut 30 is provided to be threadable with threaded bolt 22. Several different types of nuts may be used, for example, a hex nut or a wing-type nut. In one embodiment, both threaded bolt 22 and nut 30 may be fabricated from nylon.

A pin 36 fits snugly within aperture 24 of threaded bolt 22. This pin 36 has a top portion and a bottom portion. Beginning at the top portion of pin 36, an aperture 38 extends radially therein. This aperture may extend partially therein. At the top portion of pin 36, a second rim 40 is shown, which acts to prevent pin 36 from falling through a mounting bracket hole 58 of toilet seat 18. A conventional toilet seat 18 typically has a plurality of mounting brackets 56, each of which include bracket hole 58 therein.

Figure 3:
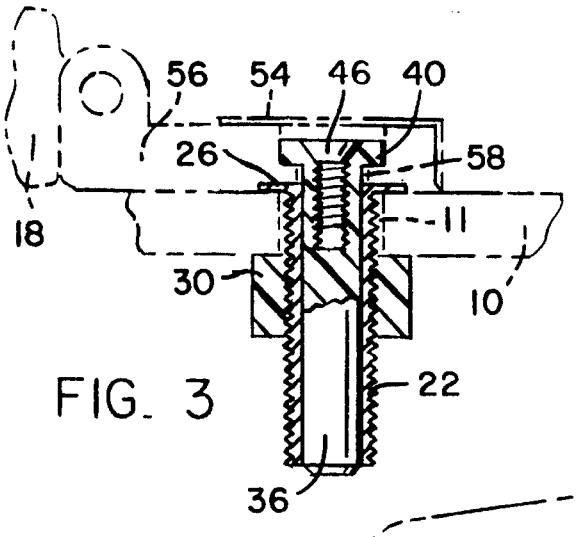
FIG. 3 shows a vertical sectional view of the components of the present invention.

As shown in FIG. 3, the internal wall which forms aperture 38 may be threaded to accommodate a threaded screw 46. In addition, beginning at the top of pin 36, there are a plurality of slots 42, which extend downward along the outer circumference of pin 36. In one embodiment, and as shown in FIG. 2, there are four such slots. These four slots divide the cross-sectional diameter of pin 36 into four quarters. Each of these slots provide pin 36 with a yielding characteristic, ultimately allowing an expansion of the radius of pin 36. Therefore, these slots provide one structure, among others, for expanding the radius of pin 36.

The radial expansion may be accomplished by threading screw 46 into the threaded aperture 38 of pin 36. Since screw 46 may have a diameter slightly larger than the diameter of threaded aperture 36, screw 46, when threaded with pin 36, forces the expansion of the radius of pin 36. When the radius of pin 36 expands, the contact pressure between pin 36 and bracket hole 58 of toilet seat mounting bracket 56 increases, thereby securing pin 36 with toilet seat 18. Furthermore, the radial expansion of pin 36 may increase the ultimate contact pressure between pin 36 and threaded bolt 22, thereby securing pin 36 in contact with threaded bolt 22. Screw 46 has a slotted end 48 which allows a user to use a screwdriver, such as a PHILLIPS head, or equivalent tool to rotate screw 46 for insertion and removal therein. In addition, there is also a bevel head 50 on screw 46 which has a radial diameter which increases slightly until it reaches its widest diameter at the top of screw 46. While screw 46 is rotated fully into position, this bevel head 50 acts to increase the radial expansion of the pin, thereby resulting in a more secured contact for pin 36 with toilet seat mounting bracket 56.

In the complete and operative preferred embodiment, the invention as described is used to attach toilet seat 18 to toilet bowl basin 10 by first dropping threaded bolt 22 into a hole of toilet bowl basin 10. Typically, toilet bowl basins are provided with two basin holes 11 for allowing two bolts to extend therethrough for the attachment of a toilet seat. Therefore, a preferably identical second threaded bolt 22 is dropped into the remaining hole on the toilet bowl basin 10. The rim 26 on the top of threaded bolt 22 prevents threaded bolt 22 from falling through basin hole 11 of toilet bowl basin 10. Nut 30 is thereafter screwed tightly into place so that threaded bolt 22 is firmly attached to toilet bowl basin 10.

Elongated pin 36 is then dropped into one of bracket holes 58 provided for in toilet seat mounting bracket 56. Typically, toilet seats have two seat mounting brackets 56, each of which contain bracket hole 58 for connecting a toilet seat to a toilet bowl basin. Therefore, a second pin 36, which preferably is identical to the first pin 36, is then dropped into the remaining bracket hole 58 on second seat mounting bracket 56 of toilet seat 18. Pin 36 does not fall through bracket hole 58 of toilet seat 18 because the diameter of rim 40 is greater than the diameter of bracket hole 58. In one embodiment, the next step is to thread screw 46 into threaded aperture 38. This will expand the radius of pin 36, and securely contact pin 36 and toilet seat mounting bracket 56. Once both screws are threaded, the operator may simply force pins 36 into aperture 24 of threaded bolt 22. Caps 54 may also be snapped into place over the top of connection device 20 to provide a more aesthetic and pleasing toilet seat connector. Caps 54 may be connected to mounting bracket 56, and may pivot at one side and snap into place on the other side.

In the preferred embodiment, in order to remove toilet seat 18 from toilet bowl basin 10, the operator simply grips toilet seat 18 in the rear, near mounting brackets 56, and lifts toilet seat 18 vertically upward. The person removing the seat can then proceed with cleaning those hard to get areas surrounding the toilet seat connector 20, as well as those inaccessible areas of the toilet seat. Moreover, since the rim 26 of the threaded bolt 22 covers the outer diameter of basin hole 11, there is no reason to remove threaded bolt 22 of the present invention for cleaning.

Once the task of cleaning is completed, the seat may be simply attached as described above.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A connector for removably attaching a toilet seat mounting bracket to a toilet seat via a hole in the toilet bowl, comprising:

a threaded bolt having a diameter to be received in said hole and having an aperture extending axially therein from a first end thereof, said threaded bolt having a radial rim at said first end such that when said threaded bolt is inserted into a toilet bowl basin hole, said threaded bolt is restrained from falling through said basin hole by said rim;

a nut threadable on said threaded bolt for attaching said bolt to said bowl;

a radially expandable pin having a radius and a threaded hole formed axially therein at a first end, said radially expandable pin having a peripheral rim at said first end thereof such that when said radially expandable pin is inserted through a bracket hole in said bracket and into said aperture of said threaded bolt, said radially expandable pin is restrained from falling through said bracket hole by said peripheral rim, said radially expandable pin having a plurality of partial slots extending from said first end of said radially expandable pin so as to facilitate radial expansion of said pin; and means threadable into said threaded hole for expanding the radius of said pin so as to secure said pin to said bracket hole.

2. The toilet seat connector of claim 1, said radially expandable pin being inserted into said aperture of said threaded bolt such that said radially expandable pin is secured to said threaded bolt.

3. The toilet seat connector of claim 1, wherein the threaded bolt is elongated.

4. The toilet seat connector of claim 1, in combination with a toilet seat and a toilet bowl basin, said toilet seat having a mounting bracket, said mounting bracket having a bracket hole therein, said toilet bowl basin having a basin hole therein.

5. The toilet seat connector of claim 1, wherein the means for expanding the radius of said radially expandable pin comprises a threaded screw.

6. The toilet seat connector of claim 5, wherein said threaded screw is threaded to said threaded hole of said radially expandable pin so that said radius of said radially expandable pin is expanded.

7. The toilet seat connector of claim 1, wherein the means for expanding the radius of said radially expandable pin comprises a self-tapping screw.

8. The toilet seat connector of claim 1, wherein the nut is a hex nut.

9. The toilet seat connector of claim 1, wherein the nut is a wing nut.

10. The toilet seat connector of claim 1, wherein the threaded bolt, the nut, and the radially expandable pin comprise nylon.

11. The toilet seat connector of claim 1, further comprising a toilet seat having a mounting bracket, said mounting bracket having a bracket hole, said radially expandable pin inserted into said bracket hole, said radially expandable pin being expanded so that said pin is secured to said mounting bracket.

12. A method for removing a toilet seat from a toilet bowl basin, comprising the steps:

selecting a toilet bowl basin and a toilet seat, said toilet seat connected to said toilet blow basin with a removable and attachable toilet seat connector, said toilet seat connector comprising:

a threaded bolt having a diameter to be received in said hole and having an aperture extending axially therein from a first end thereof, said threaded bolt having a radial rim at said first end such that when said threaded bolt is inserted into a toilet bowl basin hole, said threaded bolt is restrained from falling through said basin hole by said rim;

a nut threadable on said threaded bolt for attaching said bolt to said bowl;

a radially expandable pin having a radius and a threaded hole formed axially therein at a first end, said radially expandable pin having a peripheral rim at said first end thereof such that when said radially expandable pin is inserted through a bracket hole in said bracket and into said aperture of said threaded bolt, said radially expandable pin is restrained from falling through said bracket hole by said peripheral rim, said radially expandable pin having a plurality of partial slots extending from said first end of said radially expandable pin so as to facilitate radial expansion of said pin;

means threadable into said threaded hole for expanding the radius of said pin so as to secure said pin to said bracket hole; and removing said radially expandable pin from said aperture of said threaded bolt.

13. The method of claim 12, wherein the removing step comprises pulling upward on said toilet seat.

* * * * *